US006414253B1

(12) United States Patent
Kang

(10) Patent No.: US 6,414,253 B1
(45) Date of Patent: Jul. 2, 2002

(54) OBJECT INSERTION/SEPARATION SENSING APPARATUS

(75) Inventor: Il-Kwon Kang, Suwon (KR)

(73) Assignee: Samsung Electronics, Co., Ltd., Suwon (TW)

( * ) Notice: Subject to any disclaimer, the term of this patent is extended or adjusted under 35 U.S.C. 154(b) by 0 days.

(21) Appl. No.: 09/489,925

(22) Filed: Jan. 24, 2000

(30) Foreign Application Priority Data

Jun. 16, 1999 (KR) ..... 99-22528

(51) Int. Cl.[7] ..... H01H 3/16
(52) U.S. Cl. ..... 200/61.61; 200/341
(58) Field of Search ..... 200/517, 520, 200/521, 341, 342, 61.59, 345

(56) References Cited

U.S. PATENT DOCUMENTS 3,423,554 A * 1/1969 Acord ..... 200/153
4,265,440 A 5/1981 Shibazaki et al.
4,544,811 A * 10/1985 Brevick ..... 200/5 R
4,857,684 A * 8/1989 Gratke ..... 200/600
4,864,085 A * 9/1989 Hanajima et al. ..... 200/5 A
4,937,402 A * 6/1990 Kyoden ..... 200/5 R
4,939,324 A * 7/1990 English et al. ..... 200/345
5,117,077 A * 5/1992 Sakurada ..... 200/516
5,220,352 A * 6/1993 Yamamoto et al. ..... 346/76 PH
5,249,874 A 10/1993 Daggs
5,422,447 A * 6/1995 Spence ..... 200/5 A
5,436,418 A 7/1995 Tamehira
5,747,756 A * 5/1998 Boedecker ..... 200/5 A
5,862,349 A 1/1999 Cho et al.
5,898,147 A * 4/1999 Domzalski et al. ..... 200/1 B
5,929,401 A * 7/1999 Flegeo et al. ..... 200/5 A
5,938,009 A * 8/1999 Huang ..... 200/517

* cited by examiner

*Primary Examiner*—P. Austin Bradley
*Assistant Examiner*—Hhung Nguyen
(74) *Attorney, Agent, or Firm*—Robert E. Bushnell, Esq.

(57) ABSTRACT

An object insertion and separation sensing apparatus and method is provided for detecting the insertion or separation of a predetermined object into or from a main body. Included is a tactile switch installed on a circuit board provided in the main body, an elastic plate installed spaced a predetermined distance from the tactile switch and elastically pressing the tactile switch by an external force, an elastic member installed to face the tactile switch with respect to the elastic plate where the elastic plate is interposed between the elastic member and the tactile switch, one end of the elastic member is contacting the elastic plate, and a button having one end thereof contacting the other end of the elastic member and the other end thereof pressed by the object being inserted in the main body, so that the elastic member and the elastic plate are consecutively pressed to operate the tactile switch. Thus, the impact according to the collision with the paper cassette which is an object to be inserted and separated is separately received by the compression spring and the elastic plate so that deformation of the collision portion can be reduced. Also, when the object enters, more allowance in the distance of the excessive movement can be secured so that the burden in the manufacture can be lessened.

16 Claims, 5 Drawing Sheets

OBJECT INSERTION/SEPARATION SENSING APPARATUS

CLAIM OF PRIORITY

This application makes reference to, incorporates the same herein, and claims all benefits accruing under 35 U.S.C. §119 from an application entitled An Insertion Detecting Apparatus earlier filed in the Korean Industrial Property Office on Jun. 16, 1999, and there duly assigned Ser. No. 99-22528 by that Office.

BACKGROUND OF THE INVENTION

1. Field of the Invention

The present invention relates to an object sensor and, more particularly to an object insertion and separation sensing apparatus and method for detecting whether an object such as a paper cassette of a printer has been inserted into and separated from a predetermined main body.

2. Description of the Related Art

Different mechanisms have been used for detecting whether an object has been inserted or separated from a main body of a device. An example of an object is a paper cassette holding a specific type and size of paper. An example of a device is a printing device such as a printer or copier. There has to be a mechanism that can properly detect when the paper cassette is inserted into the printing device and when the paper cassette is removed from the printing device. Such a mechanism needs to be both economical and durable. The inserted object may sometimes be directly in contact with a switch used to detect the insertion of the object. In such a circumstance, the force of the object such as a paper cassette may damage the switch. The small range of operation of a switch, compared to the distance of movement of an object such as a paper cassette (or tray) increases the likelihood of the switch being damaged. The conventional art discloses an assortment of devices for detecting an object being inserted or removed.

An exemplar of the contemporary art, Shibazaki, et al. (U.S. Pat. No. 4,265,440, Computer-Controlled Paper Feeder, May 5, 1981) discloses a paper cassette that directly contacts a microswitch or reed switch that are positioned adjacent to the exit opening of the cassette. The reed switch can be damaged by the direct force of the paper cassette. Such a solution is not very reliable. Tamehira (U.S. Pat. No. 5,436,418, Cassette Size Detecting Mechanism, Jul. 25, 1995) discloses a copier that can detect different size paper cassettes. When a cassette is inserted, the cassette strikes a detection block which in turn abuts against an actuator portion, which in turn rotates on a hinge portion. The actuator portion has springs that impart force on the switches. Such a solution has many moving parts that may be damaged. The structure of switch operating mechanism is such that a sharp force may impart strong deformity into the structure. Cho et al. (U.S. Pat. No. 5,862,349, Method and Apparatus for Docking and Undocking a Notebook Computer, Jan. 19, 1999), teaches a method and apparatus for detecting if a notebook computer is inserted in the docking station. This method is cost prohibitive in that electrical circuitry has to be installed on both the docking station and the object being inserted like the notebook computer. Daggs (U.S. Pat. No. 5,249,874, Ribbon Cartridge, Oct. 5, 1993) discloses a way of detecting when a ribbon is inserted in a printing device. The switch operating mechanism has an arm with a pivot point. One side is impacted and the other side pivots to impart force on the switch. This method however, allows for only a small range of motion for the object being inserted. Furthermore, the impact force is not dampened in any way to avoid damage to the switch that signifies whether an object has been inserted or not.

SUMMARY OF THE INVENTION

To solve the above problems, it is an objective of the present invention to provide an object insertion and separation sensing apparatus having an improved structure so that deformation of a portion directly contacting an object such as a paper cassette inserted and separated can be prevented.

Another objective is to avoid an object directly contacting a switch.

It is a further object have a mechanism that is cost efficient and durable.

It is also an object to have a mechanism for detecting an insertion and separation of an object that is modular because a modular design would allow the mechanism to be manufactured separately, thus allowing a low cost of manufacture.

It is another object to provide more allowance in the distance of the excessive movement of an object when the object enters a main body so that the burden in the manufacture can be lessened.

It is a further object to dampen the amount of force imparted on a switch for detecting the insertion or withdrawal of an object.

Accordingly, to achieve these and other objects, there is provided an object insertion and separation sensing device for detecting the insertion or separation of a predetermined object into or from a main body. The device has a tactile switch installed on a circuit board provided in the main body. An elastic plate is installed and set a predetermined distance from the tactile switch and elastically pressing the tactile switch by an external force. An elastic member is installed to face the tactile switch. The elastic plate is interposed between the elastic member and the tactile switch. Furthermore, the elastic member has one end contacting the elastic plate. A button has one end contacting the other end of the elastic member. The other end of the button is pressed by the object being inserted in the main body, so that the elastic member and the elastic plate are consecutively pressed to operate the tactile switch.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
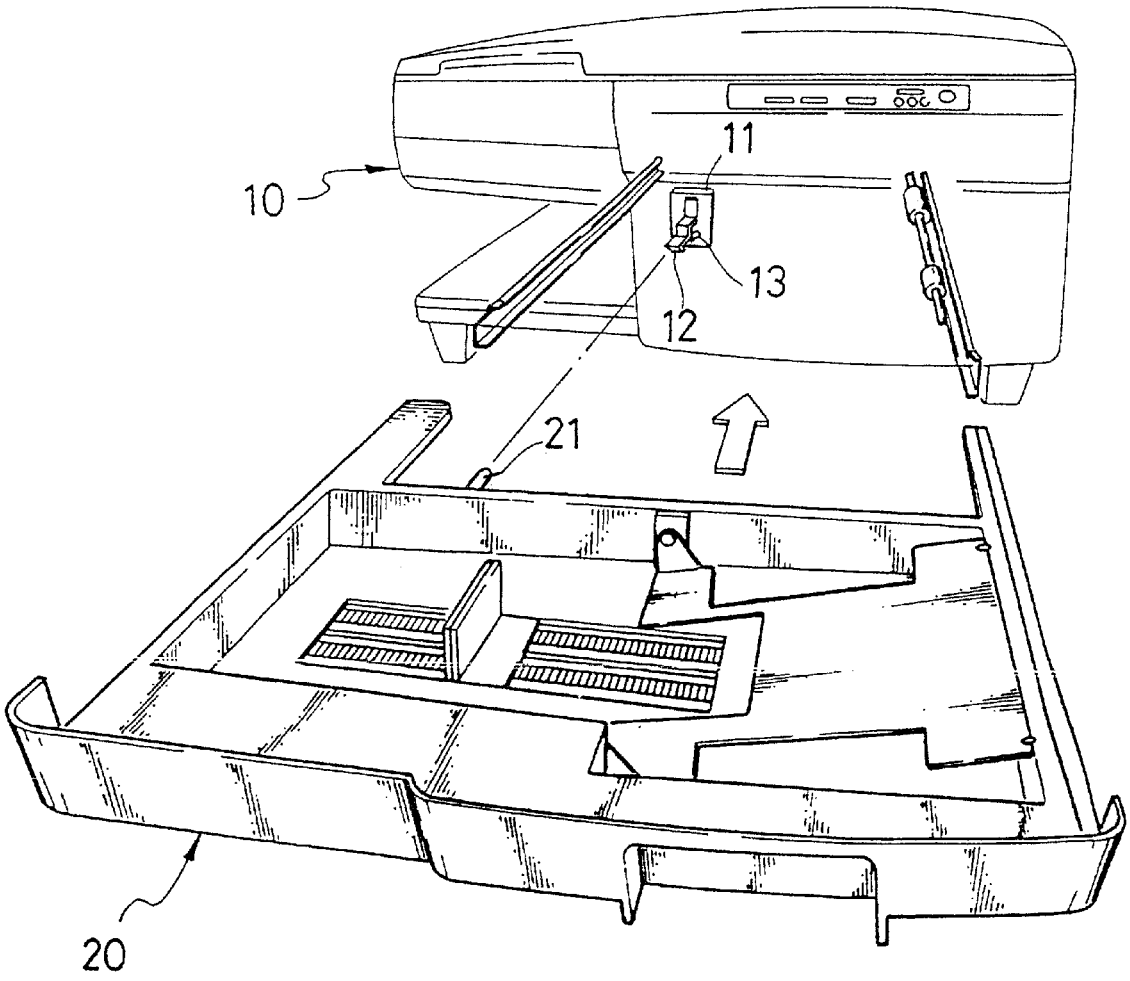
FIG. 1 is a perspective view showing an object insertion and separation sensing apparatus applied to a paper cassette of a printing apparatus.

A printing apparatus such as a printer or a copier is provided with a paper cassette for supplying sheets of paper to the main body of the printing apparatus. As shown in FIG. 1, a paper cassette 20 for accommodating a number of sheets of paper is coupled to one side of a main body 10 of the printing apparatus. A sensing portion for detecting whether the paper cassette 20 is inserted is installed in the main body 10 of the printing apparatus. Thus, the presence of the paper cassette 20 can be detected when a protrusion 21 provided at the paper cassette 20 presses the sensing portion as it is inserted into the printing device or releases the sensing portion as it is separated from the printing device.

Figure 2:
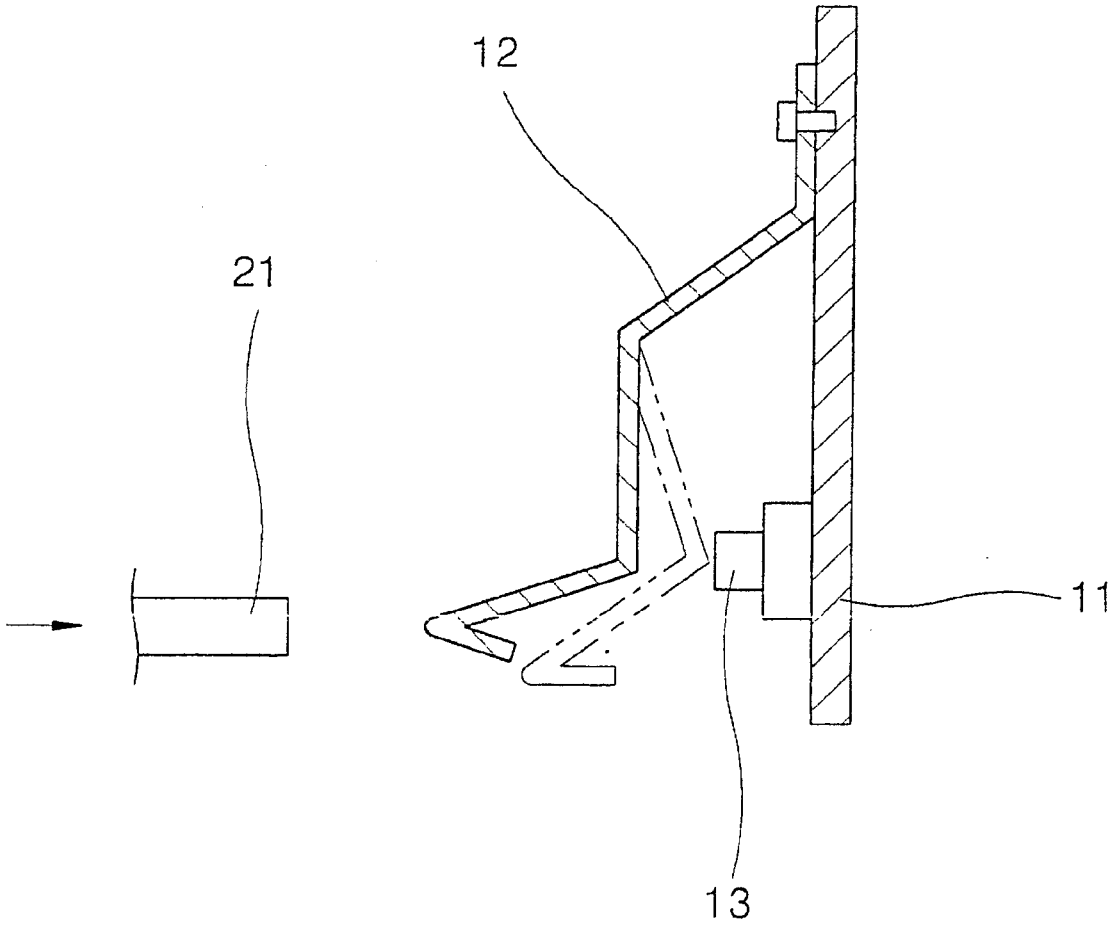
FIG. 2 is a sectional view showing the object insertion and separation sensing apparatus shown in FIG. 1.

The sensing portion, as shown in FIGS. 1 and 2, includes a tactile switch 13 provided on a circuit board 11 and a leaf spring 12 installed above the tactile switch 13. Thus, when the protrusion 21 presses the leaf spring 12 as the paper cassette 20 enters, the leaf spring 12 is elastically bent to press the tactile switch 13 so that a signal is generated. The reason why the tactile switch 13 is indirectly pressed by the leaf spring 12 is that the operational range of the tactile switch 13 being pressed is about 0.5 mm (millimeters) which is very small compared to the distance of movement of the inserted paper cassette 20. That is, it is quite difficult to adjust positional allowance of the paper cassette 20 such that the protrusion 21 can accurately press the tactile switch 13 as much as 0.5 mm when the paper cassette 20 is completely coupled to the main body 10 of the printing apparatus. Thus, by installing the leaf spring 12, the range of being pressed by the protrusion 21 is magnified as much as the amount of elastic deformation. Accordingly, when the protrusion 21 presses the tactile switch 13 while moving and exceeding the operational range of 0.5 mm, the leaf spring 12 is elastically deformed while absorbing the distance of the excessive movement.

In this structure, since the protrusion 21 directly collides and presses the leaf spring 12 which is a thin plate, as the paper cassette 20 is repeatedly inserted and separated, the leaf spring 12 can be easily deformed by the collision so that on and off actions of the tactile switch 13 may not work well.

Figure 3:
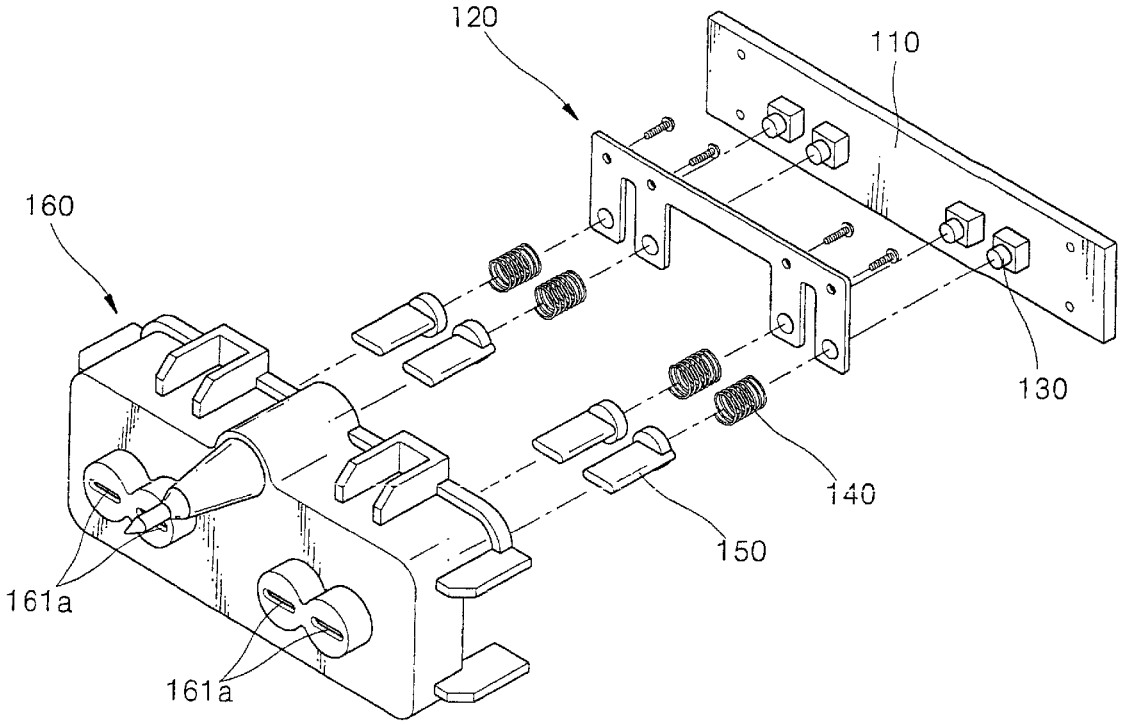
FIG. 3 is an exploded perspective view showing an object insertion and separation sensing apparatus constructed according to the principles of the present invention, viewed from the front side.
Figure 4:
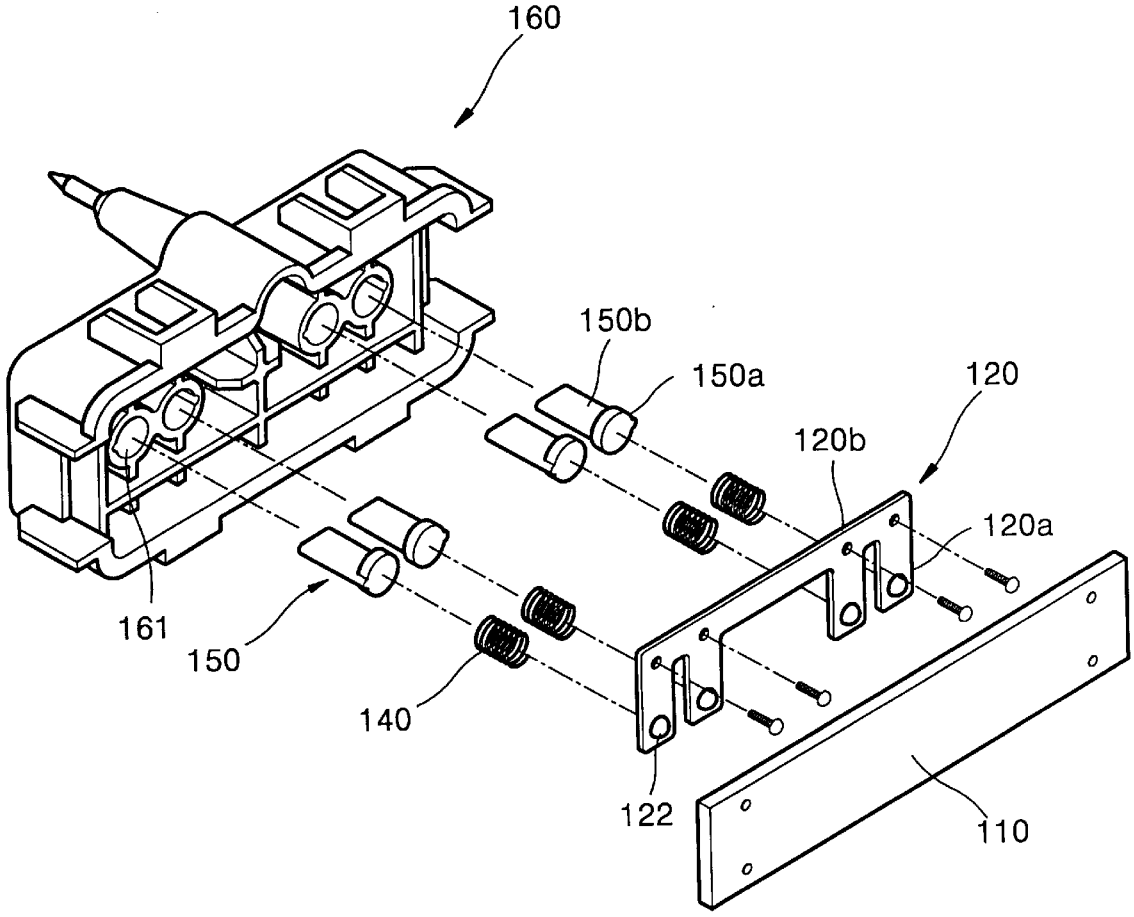
FIG. 4 is an exploded perspective view showing an object insertion and separation sensing apparatus viewed from the rear side.
Figure 5:
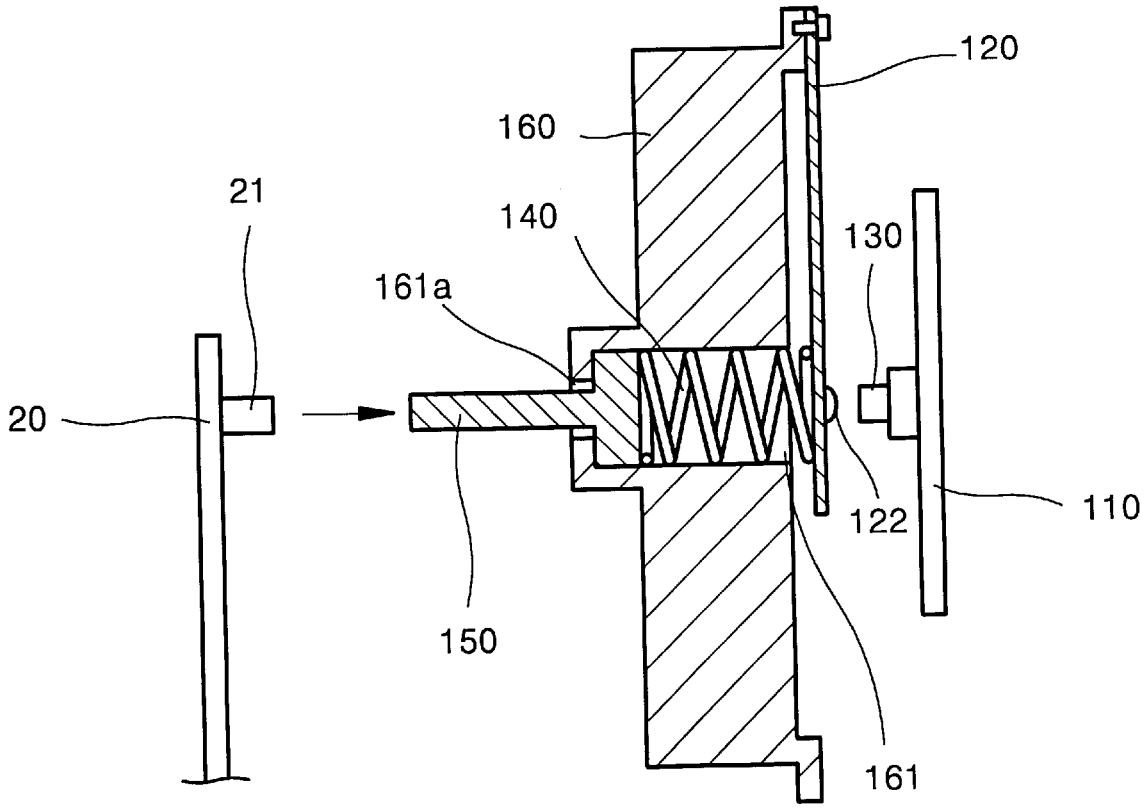
FIG. 5 is a sectional view showing the object insertion and separation sensing apparatus shown in FIG. 3.

Referring collectively to FIGS. 3 through 5, the object insertion and separation sensing apparatus of the present invention includes a tactile switch 130 installed at a circuit board 110 provided in a main body 10 (see FIG. 1) of a printing apparatus such as a printer or copier, an elastic plate 120 is installed to be spaced a predetermined distance from the tactile switch 130. An elastic member 140 such as a compression spring is installed to face the tactile switch 130 with respect to the elastic plate 120 interposed therebetween, and a button 150 which is in contact with the compression spring 140 and pressed by a paper cassette 20 as the paper cassette 20 enters the main body 10 of the printing apparatus. Reference numeral 160 denotes a case installed in the main body 10 of the printing apparatus in which the button 150 and the compression spring 140 are accommodated and supported in a receiving groove 161 provided at the case 160. The elastic plate 120 is supported in the case 160 while one end thereof is secured to the case 160. Also, the compression spring 140 is installed between the elastic plate 120 and the button 150 and applies an elastic force to the button 150 so that one end of the button 150 can protrude through a slot 161*a* provided at the case 160.

The button 150 has the first end 150*a* being circular and the second end 150*b* being oval, a surface area of the second end 150*b* being less than the surface area of the first end, thus allowing only a portion of the button 150 to protrude through the slot 161*a* of said case 160. The elastic member (compression spring) 140 is a circular shaped spring having a diameter about equal to the diameter of the circular first end 150*a* of the button 150, thus absorbing a maximum force between the button 150 and the elastic plate 120. The button 150 is installed in a cylindrically shaped receiving groove 161 within the case 160, the groove 161 has a diameter about equal to the diameter of the circular end of the button 150. The first end of the button 150 has less surface area than the second end of the button 150. The button 150 has a right circular cylindrical portion on the first end 150*a* of the button 150 and an oval cylindrical portion at the second end 150*b*, the oval cylindrical portion 150*b* being longer than the right circular cylindrical portion 150*a*.

The case 160 has the cylindrically shaped groove 161 accommodating the button 150 and the resilient member (compression spring) 140. The second end 150*b* of the button 150 protrudes through an oval shaped slot 161*a* formed on one side of the case 160 at an end of the cylindrically shaped groove 161. The elastic plate 120 is fastened on one end to the case 160. The resilient member (compression spring) 140 is a circular shaped compression spring 140 having a diameter about equal to the diameter of the right circular cylindrical portion 150*a* of the button 150.

The elastic plate 120, as seen in FIGS. 3 through 5, includes a plurality of extended elastic plate portions 120*a* that all project from the same secured portion 120*b* of the elastic plate 120. The plurality of extended elastic plate portions 120*a* and the secured portion 120*b* are formed as a single unit of the elastic plate 120. Each one of the extended elastic plate portions 120*a* is in contact with a separate button 150 and a separate tactile switch 130 when the paper cassette 20 is inserted into the main body 10. The raised face 122 on the extended portion 120*a* contacts the tactile switch 130 when the button 150 is pressed.

In the operation of the object insertion and separation sensing apparatus having the above structure, when the paper cassette 20 enters the main body 10 of the printing apparatus, as shown in FIG. 5, the protrusion 21 provided at the paper cassette 20 presses the button 150 protruding through the slot 161*a*. Accordingly, the compression spring 140 pressing the button 150 is compressed and further presses the elastic plate 120. At this time, the elastic plate 120 presses the tactile switch 130 to turn it on.

When the paper cassette 20 is separated from the main body 10 of the printing apparatus, the elastic plate 120 and the compression spring 140 pressing the tactile switch 130 are elastically returned to their initial states. Accordingly, the tactile switch 130 is turned off.

As the paper cassette 20 enters, the button 150 is pressed by the protrusion 21 and consecutively the tactile switch 30 is pressed via the compression spring 140 and the elastic plate 120. Therefore, the impact according to the collision with the paper cassette 20 can be divided and received by the compression spring 140 and the elastic plate 120. Consequently, there is little possibility of deformation of the collision portion, compared to the embodiment shown in FIGS. 1 and 2 in which the paper cassette 20 collides with the thin leaf spring (12 of FIG. 1) only. Also, the distance of excessive movement of the paper cassette 20 mentioned above is doubly absorbed by the compression spring 140 and the leaf spring 120, thus more allowance with respect to the distance of movement can be secured so that the burden of the manufacturer can be lessened.

Although the object insertion and separation sensing apparatus of the present invention is described in the present embodiment as being applied to the paper cassette of a printing apparatus, it can also be applied to any case in which an object inserted in or separated from a predetermined main body.

As described above, in the object insertion and separation sensing apparatus according to the present invention, as the impact according to the collision with the paper cassette which is an object to be inserted and separated is separately received by the compression spring and the elastic plate, deformation of the collision portion can be reduced. Also, when the object enters, more allowance in the distance of the excessive movement can be secured so that the burden in the manufacture can be lessened.

What is claimed is:

1. An apparatus, comprising:

a tactile switch installed on a circuit board positioned within a main body to detect both an insertion and a removal of a predetermined object from the main body;

an elastic plate installed and spaced a predetermined distance from said tactile switch and elastically pressing said tactile switch in response to application of an external force to said elastic plate;

an elastic member installed to face said tactile switch, a first end of said elastic member contacting said elastic plate, said elastic plate being interposed between said elastic member and said tactile switch; and a button having a first end contacting a second end of said elastic member and a second end of said button being pressed by the predetermined object when the predetermined object is inserted in the main body, said elastic member and said elastic plate being pressed in succession by said button to operate said tactile switch, with said button, said elastic member and said elastic plate being installed and supported in case provided in the main body and the second end of said button protruding towards said object through a slot formed in said case, with said button having the first end being circular and the second end being oval, a surface area of the second end being less than the surface area of the first end, thus allowing only a portion of said button to protrude through the slot of said case.

2. The apparatus of claim 1, with said elastic member being a circular shaped spring having a diameter substantially equal to the diameter of the circular first end of said button, thus absorbing a maximum force between said button and said elastic plate.

3. The apparatus of claim 1, with said button being installed in a cylindrically shaped groove within said case, the groove having a diameter substantially equal to the diameter of the circular end of said button.

4. An apparatus, comprising:

a tactile switch installed on a circuit board positioned within a main body to detect both an insertion and a removal of a predetermined object from the main body;

an elastic plate installed and spaced a predetermined distance from said tactile switch and elastically pressing said tactile switch in response to application of an external force to said elastic plate;

an elastic member installed to face said tactile switch, a first end of said elastic member contacting said elastic plate, said elastic plate being interposed between said elastic member and said tactile switch; and a button having a first end contacting a second end of said elastic member and a second end of said button being pressed by the predetermined object when the predetermined object is inserted in the main body, said elastic member and said elastic plate being pressed in succession by said button to operate said tactile switch, with one end of said elastic plate being attached to a case accommodating said button, said case provided in the main body.

5. An apparatus, comprising:

a tactile switch installed on a circuit board positioned within a main body of a printing apparatus to detect both an insertion and a removal of a paper cassette from the main body;

an elastic plate spaced a predetermined distance from said tactile switch and elastically pressing said tactile switch in response to application of an external force to said elastic plate;

a resilient member installed to face said tactile switch, a first end of said resilient member contacting said elastic plate, said elastic plate being interposed between said resilient member and said tactile switch;

a button having a first end contacting a second end of said resilient member and a second end of said button being pressed by a paper cassette when the paper cassette is inserted in said main body, said resilient member and said elastic plate being pressed in succession by said button to operate said tactile switch, the first end of said button having less surface area than the second end of said button, said button having a right circular cylindrical portion on the first end of said button and an oval cylindrical portion at the second end, the oval cylindrical portion being longer than the right circular cylindrical portion; and a case having a cylindrically shaped groove accommodating said button and said resilient member, the second end of said button protruding through an oval shaped slot formed on one side of said case at an end of the cylindrically shaped groove, said elastic plate being fastened on one end to said case.

6. The apparatus of claim 5, with said resilient member being a circular shaped compression spring having a diameter substantially equal to the diameter of the right circular cylindrical portion.

7. A method, comprising the steps of:

attaching a circuit board to a main body;

installing a tactile switch on said circuit board, said tactile switch detecting both an insertion and removal of a predetermined object from said main body;

installing an elastic plate spaced a predetermined distance from said tactile switch and elastically pressing said tactile switch in response to application of an external force to said elastic plate;

installing a resilient member having a first end facing said tactile switch and contacting said elastic plate, said elastic plate being interposed between an elastic member and said tactile switch;

contacting a first end of a button to said resilient member and a second end of said button contacting a protrusion from a predetermined object; and inserting the second end of said button through a groove in one side of a case and protruding through a slot at another side of said case.

8. The method of claim 7, further comprising the step of fastening one end of said elastic plate to said case.

9. The method of claim 8, further comprising the step of fastening said case to said main body, said case accommodating said button, said resilient member and said elastic plate.

10. The method of claim 9, with said object being a paper cassette inserted into and separated from a main body of a printing apparatus.

11. The method of claim 10, with said button having the first end being circular and the second end being oval, a surface area of the second end being less than the surface area of the first end of said button, thus allowing only a portion of said button to protrude through the slot of said case.

12. The method of claim 11, with said elastic member being a circular shaped compression spring having a diameter substantially equal to the diameter of the circular first end of said button.

13. The method of claim 12, with said button being installed in a cylindrically shaped groove within said case, the groove having a diameter substantially equal to the diameter of the circular end of said button.

14. An apparatus, comprising:

a plurality of tactile switches installed on a circuit board positioned within a main body to detect both an insertion and a removal of a predetermined object from the main body;

an elastic plate installed and spaced a predetermined distance from said tactile switches and elastically pressing said tactile switches in response to application of an external force to said elastic plate;

a plurality of elastic members installed to face said tactile switches, a first end of each one of said elastic members contacting said elastic plate, said elastic plate being interposed between said elastic members and said tactile switches; and a plurality of buttons with each one including a first end contacting a second end of one of said elastic members and a second end of one of said buttons being pressed by the predetermined object when the predetermined object is inserted in the main body, said elastic members and said elastic plate being pressed in succession by said buttons to operate said tactile switches, with said elastic plate further comprising:

a secured portion fastened to a case housing said buttons, said elastic members, and said elastic plate, said case provided in the main body; and a plurality of extended portions projecting from said secured portion.

15. The apparatus of claim 14, with said plurality of extended portions integrally formed with said secured portion in a single unit, each one of said elastic members in contact with a respective one of said extended portions, and when said buttons are pressed by the predetermined object, each one of said extended portions operates a respective one of said tactile switches.

16. An apparatus, comprising:

a tactile switch installed on a circuit board positioned within a main body to detect both an insertion and a removal of a predetermined object from the main body;

an elastic plate installed and spaced a predetermined distance from said tactile switch and elastically pressing said tactile switch in response to application of an external force to said elastic plate;

an elastic member installed to face said tactile switch, a first end of said elastic member contacting said elastic plate, said elastic plate being interposed between said elastic member and said tactile switch;

a button having a first end contacting a second end of said elastic member and a second end of said button being pressed by the predetermined object when the predetermined object is inserted in the main body, said elastic member and said elastic plate being pressed in succession by said button to operate said tactile switch, with said elastic plate further comprising:

a secured portion fastened to a case housing said button, said elastic member, and said elastic plate, said case provided in the main body; and a plurality of extended portions projecting from said secured portion, with said plurality of extended portions integrally formed with said secured portion in a single unit, said elastic member in contact with a first one of said extended portions, and when said button is pressed by the predetermined object, said extended portion operates said tactile switch;

a second tactile switch installed on the circuit board positioned within the main body to detect both an insertion and a removal of the predetermined object from the main body;

a second one of said extended portions of said elastic plate installed and spaced a predetermined distance from said second tactile switch and elastically pressing said second tactile switch in response to application of an external force to said second extended portion;

a second elastic member installed to face said second tactile switch, a first end of said second elastic member contacting said second extended portion, said second extended portion being interposed between said second elastic member and said second tactile switch; and a second button having a first end contacting a second end of said second elastic member and a second end of said second button being pressed by the predetermined object when the predetermined object is inserted in the main body, said second elastic member and said second extended portion being pressed in succession by said second button to operate said second tactile switch.

* * * * *